United States Patent [19]

Tsuboi

[11] Patent Number: 5,018,947

[45] Date of Patent: May 28, 1991

[54] SCREW TYPE VACUUM PUMP

[75] Inventor: Noboru Tsuboi, Kakogawa, Japan

[73] Assignee: Kabushiki Kaisha Kobe Seiko Sho, Kobe, Japan

[21] Appl. No.: 330,696

[22] Filed: Mar. 30, 1989

[30] Foreign Application Priority Data

Aug. 19, 1988 [JP] Japan ..... 63-206904

[51] Int. Cl.[5] ..... F04B 49/02; F04C 18/16

[52] U.S. Cl. ..... 417/295; 418/201.2

[58] Field of Search ..... 417/295, 281; 418/88, 418/201 A; 251/63.6

[56] References Cited

U.S. PATENT DOCUMENTS

| | | | |
|---|---|---|---|
| 3,687,017 | 8/1972 | Lewis et al. | 251/63.6 |
| 4,498,949 | 2/1985 | Schibbye et al. | 417/310 |
| 4,725,210 | 2/1988 | Suzuki et al. | 418/201 A |

*Primary Examiner*—Leonard E. Smith
*Assistant Examiner*—John A. Savio, III
*Attorney, Agent, or Firm*—Oblon, Spivak, McClelland, Maier & Neustadt

[57] ABSTRACT

A screw type vacuum pump has in a passage leading to its suction port a check valve which is adapted to open the valve securely by hydraulic pressure to open the gas flow passage without the hunting phenomenon. This permits the selection of a spring with a suitable spring constant for seating the valve body on the valve seat securely and promptly to prevent reverse gas flows.

3 Claims, 2 Drawing Sheets

SCREW TYPE VACUUM PUMP

BACKGROUND OF THE INVENTION

1. Field of the Invention

This invention relates to a screw type vacuum pump with a check valve in a fluid passage on the suction side thereof.

2. Prior Art

Screw type vacuum pumps are generally constituted by a pair of intermeshed male and female screw rotors, a pump casing having a suction port and a discharge port on the opposite sides thereof, an overdrive mechanism for increasing the speed of the rotational driving force of a motor before transmission to a rotor, an overdrive casing serving also as an oil tank, and an oil circulating passage passing through a number of lubricant oil supply points in the pump casing, overdrive gears, oil tank, oil pump and oil cooler. A screw type vacuum pump of this sort is known, for example, from U.S. Pat. No. 4,767,284.

More specifically, as illustrated in FIG. 3, the existing screw type vacuum pump of this sort has a pair of intermeshed male and female screw rotors 19 rotatably accommodated in a casing 18 which is provided with a suction port 13 on one side and a discharge port 17 on the other side, the rotors being rotationally driven in one direction, for example, by a rotor shaft 20 which is extended through and out of the casing 18 on the side of the suction port 13. As indicated by an arrow of solid line in the same figure, a gas is taken into the pump casing 15 through the suction port 13 and discharged through the discharge port 17. However, should a suction force acting in a direction inverse to the solid line arrow occur at the suction port 13 as indicated by an arrow of broken line, gas would flow in through the discharge port in the direction of the broken line arrow, rotating the rotors in reverse directions. This happens when a vacuum tank 26 is directly connected to the suction port 13 of the vacuum pump 12 as shown by imaginary line in FIG. 3, namely, the rotors are rotated in reverse directions when the operation of the pump 12 is stopped, due to a pressure difference between the vacuum tank 26 and the atmosphere, permitting air to flow into the tank 26.

The time of reverse rotation on such an occasion is determined depending upon the size of and the pressure in the tank 26. This phenomenon of reverse rotation imposes adverse effects on bearings of the rotors and other associated parts. Namely, since the lubricant oil is supplied to the bearings and synchronous gears by an oil pump which is generally driven in synchronism with the drive source of the vacuum pump, the oil pump is stopped as soon as the vacuum pump comes to a stop.

Therefore, the rotors are rotated in reverse directions without supplying the lubricant oil to the bearings and other parts which need lubrication, imposing adverse effects thereon.

The reverse rotor rotation phenomenon also occurs in the following circumstances.

In a case where a plural number of screw type vacuum pumps 12 have their suction ports connected to a common suction passage 11 through respective branch passages 14 as shown in FIG. 4, if one pump 15 in the rightmost position in the figure alone is stopped, its rotors are caused to rotate in reverse directions by the suction forces of the two other pumps which are in operation, as indicated by an arrow of broken line. The reverse rotation of the stopped pump 15 might lead to a breakdown since it is put in operation without supply of lubricant oil to its bearings, synchronous gears and other parts which need lubrication.

In order to prevent such a situation resulting from reverse rotation of a pump 15, it is the usual practice to install a check valve 16 in each branch passage 14.

In case the check valve 16 is a commercial product, it is generally constituted by, as shown in FIG. 5, a valve casing 23 internally providing a gas flow space 22 with a valve seat 21, a valve body 24 intimately seatable on the valve seat 21, and a coil spring 25 constantly urging the valve body 24 toward the valve seat 21 for intimate engagement therewith. In this case, when a suction force exists at the suction port 13, namely, when a suction force acts in the direction of port x in the drawing, the valve is opened and gas flows from port y to port x. Conversely, when a suction force comes from other pump 15, namely, when a suction force acts in the direction of port y, the valve body 24 is held in intimate contact with the valve seat 21, thereby closing the valve to block reverse gas flows.

If the spring constant of the coil spring 25 is small, however, the vacuum pump 12 with the check valve 16 of the above-described construction suffers from a time delay in closing the valve when the suction force is reversed toward the port y, failing to completely preclude the reverse rotation of the pump 15.

On the contrary, when the spring constant is increased, there arises a problem that the valve body 24 is repeatedly hit against the valve body 21 due to the low density of influent gas in the vacuum device, causing the hunting phenomenon in which the valve is opened and closed repeatedly.

SUMMARY OF THE INVENTION

It is an object of the present invention to overcome the above-mentioned problems of the conventional devices, more particularly, to provide a screw type vacuum pump which is adapted to open and close the check valve in a prompt and secure manner.

In accordance with the present invention, this object is achieved by provision of a screw type vacuum pump construction including a pair of intermeshed male and female rotors comprising means for pumping a gas, a pump casing having a suction port and a discharge port on the opposite sides thereof, an overdrive mechanism adapted a power transmission means to increase the speed of the rotational driving force of a motor before transmission to a rotor, an overdrive transmission casing also serving as an oil tank or reservior oil circulating passages passing through lubricating points of the pump casing, overdrive gears, oil tank, oil pump and oil cooler, and a valve provided in a passage leading to the suction port of the pump casing, characterized in that the check valve comprises: a valve casing internally providing a gas flow space with a valve seat in an intermediate portion thereof and a cylinder space; a valve body holding the two spaces in fluidically isolated or shielded state from each other through a suitable seal means and passed through a partition wall between the two sapces to disengageably engage a valve portion on the side of the gas flow space intimately with the valve seat, the valve body having a piston slidably fitted in the cylinder space to define an oil chamber on the side of the gas flow space and an atmospheric chamber on the opposite side in communication with the atmosphere; a spring means constantly biasing the valve body into intimate contact with the valve seat; and bypass passages for communicating the oil chamber with the outlet of of the oil cooler and the oil tank through a three-way change-over valve adapted to switch the bypass passages to communicate the oil chamber with either the outlet of the oil cooler or the oil tank.

This check valve arrangement according to the invention uses hydraulic pressure for opening the check valve, using a spring means only at the time of closing the valve, so that it gives a broad freedom in selection of the spring constant of the spring means and can close the valve promptly and open the same in a secure manner.

The above and other objects, features and advantages of the invention will become apparent from the following description and the appended claims, taken in conjunction with the accompanying drawings which show by way of example a preferred embodiment of the invention.

DESCRIPTION OF PREFERRED EMBODIMENT

Figure 1:
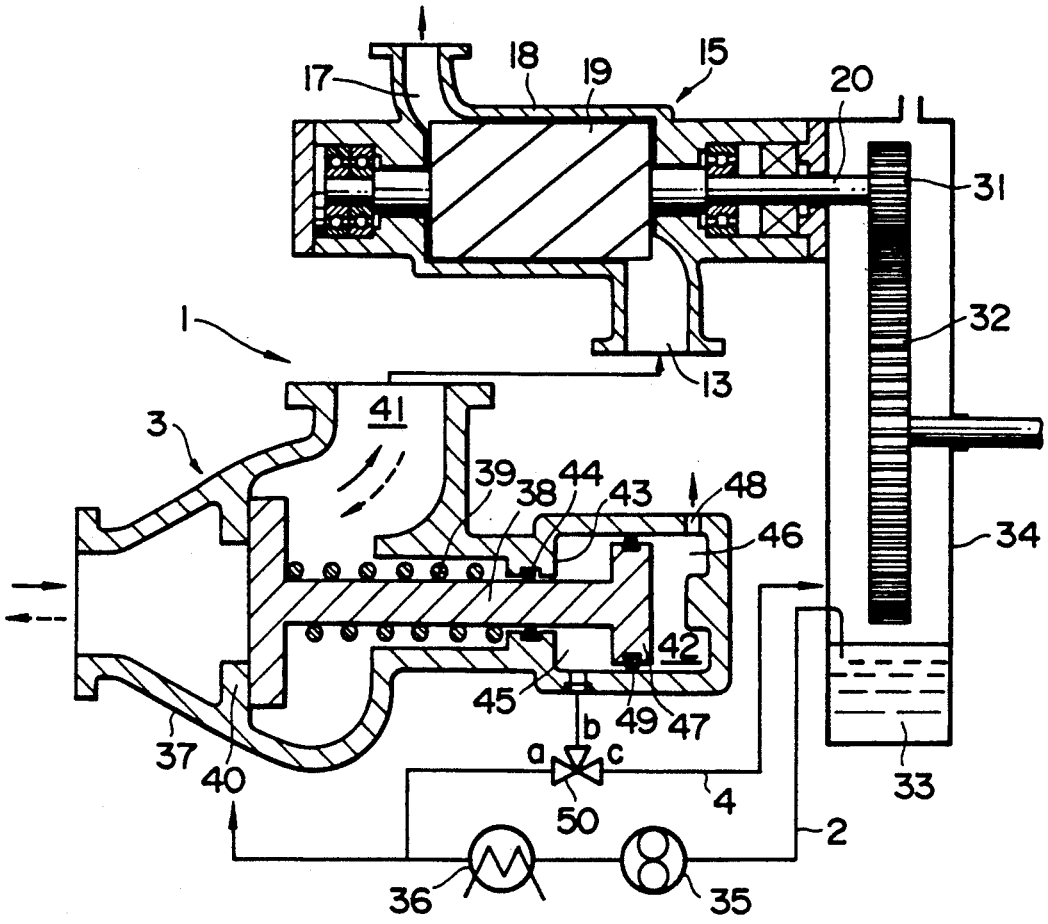
FIG. 1 is a diagrammatic sectional view of a screw type vacuum pump according to the present invention.

Now, the invention is described more particularly by way of a preferred embodiment shown in the drawings.

Figure 3:
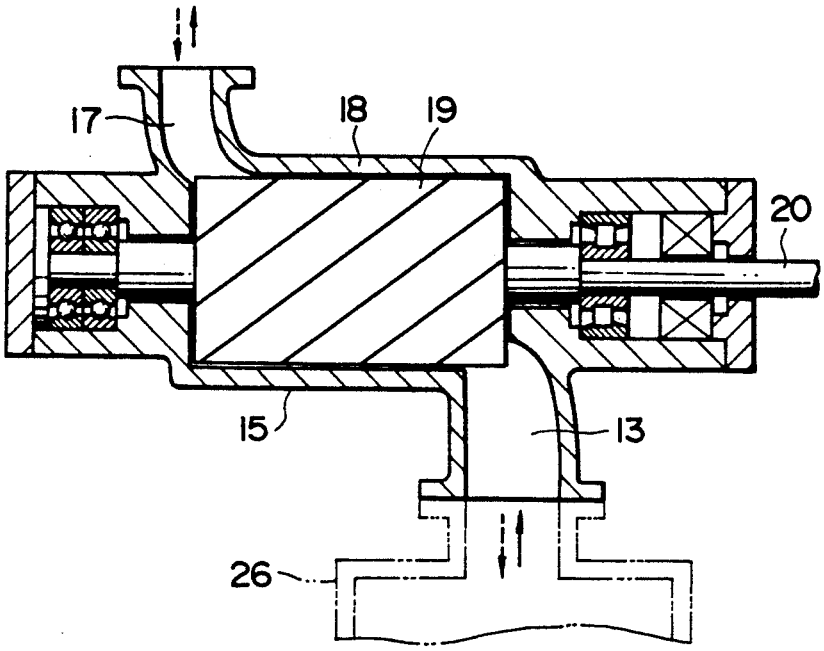
FIG. 3 is a diagrammatic sectional view of the pump assembly of the screw type vacuum pump.
Figure 5:
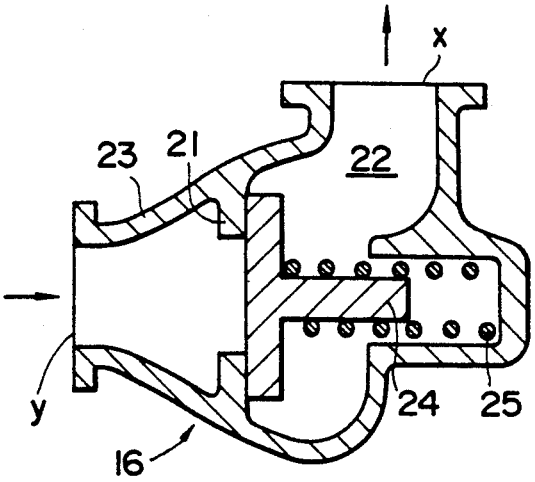
FIG. 5 PRIOR ART
FIG. 5 is a diagrammatic sectional view of a conventional check valve.
Figure 4:
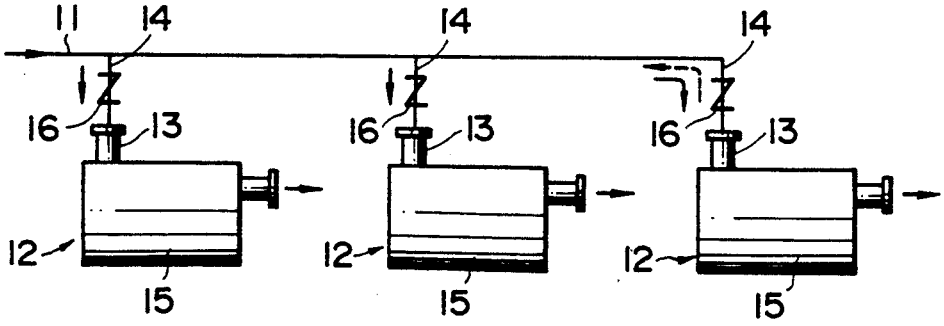
FIG. 4 PRIOR ART
FIG. 4 is a diagrammatic view of a gas system of vacuum equipments using conventional screw type vacuum pumps.

Referring to FIG. 1, there is illustrated a screw type vacuum pump 1 embodying the present invention, which includes a screw type pump casing 15, substantially same as the one shown in FIG. 3, an oil circulating passage 2, a check valve 3 and a bypass passage 4. The component parts which are common to FIG. 3 are designated by common reference numerals.

FIG. 1 further shows a pump casing portion 15 which is omitted in FIG. 3. The driving force of a motor, which is not shown, is transmitted to a screw rotor 19 through a power transmission means including intermeshed small and large gears 31 and 32 which are accommodated in an overdrive power transmission casing 34 with an oil reservoir 33 in a lower portion thereof to serve also as an oil tank or reservoir.

The oil circulating passage 2 consists of flow passages leading from the oil reservoir 33 to lubricant supply points for bearings, shaft sealers, synchronous gears and other parts in the pump casing 15 through the oil pump 35 and oil cooler 36, and thereafter returning again to the oil reservoir 33, thereby circulating the oil in the oil reservoir 33.

In this embodiment, the check valve 3 is composed of a valve casing 37, a valve body 38 and a coil spring 39. The valve casing 37 is internally provided with a gas flow space 41 which has a valve seat 40 in an intermediate portion thereof, a cylinder space 42, and a partition means provided between the just-mentioned two spaces 41 and 42.

The valve body 38 is fitted in the partition means 43 through an O-ring 44 to shield the two spaces from each other. The end portion of the valve body 38 on the side of the gas flow space 41 is configured to normally engage intimately with the valve seat 40 when in a closed position, and a piston 47 is provided on the valve body on the side of the cylinder space in such a manner as to partition the cylinder space into an oil chamber 45 on the side of the gas flow space and an atmospheric chamber 46 on the opposite side in communication with the atmosphere.

More specifically, the oil chamber 45 is supplied with oil from the oil reservoir 33 which will be described hereinlater, while the atmospheric chamber 46 is provided with a port 48 which comunicates with the atmosphere, the two chambers 45 and 46 being isolated from each other by an O-ring 49 which is fitted on the circumference of the piston 47.

The coil spring 39 is arranged to constantly urge or bias the valve body 38 into the closed position intimate contact with the valve seat 40.

The bypass passage 4 includes conduits which communicate the oil chamber 45 with the outlet of the oil cooler 33 and the oil reservoir 39 through a three-way change-over valve 50 with ports a, b and c, switching the conduits to communicate the oil chamber 45 either to the outlet of the oil cooler 36 or the oil reservoir 33.

When the ports b-c are in communication, the oil chamber 45 is communicated with the oil reservoir 33 which is under atmospheric pressure, so that the oil in the oil chamber 45 flows out toward the oil reservoir 33 and the valve body 38 is moved leftward in FIG. 1 by the action of the coil spring 39 to hold the valve in closed state.

Figure 2:
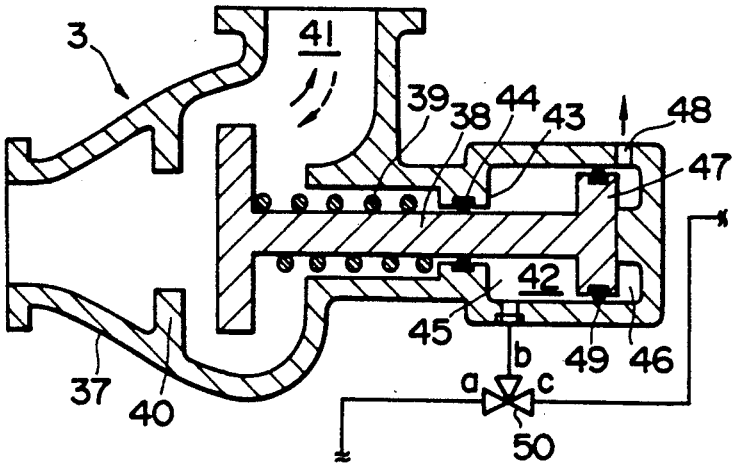
FIG. 2 is a diagrammatic sectional view of the check valve portion in operation of the pump of FIG. 1.

On the contrary, when the ports a-b are in communication with each other, the oil in the oil circulating passage 2 is led into the oil chamber 45 as shown in FIG. 2, moving the valve body 38 rightward in the same figure against the action of the spring 39 to hold the valve in an open state.

In this manner, the valve is opened by hydraulic pressure, and therefore there is a great freedom in selecting the force of the coil spring to be used for closing the valve.

The vacuum pump with above-described arrangement operates in the manner as follows.

When stopping the vacuum pump 1, the oil pump 35 is stopped, while holding the ports b-c of the three-way change-over valve 50 in communication with each other. Consequently, the oil in the oil chamber 45 is drained to the oil reservoir 33, whereupon the valve body 38 is moved into intimate contact with the valve seat 40 by the action of the coil spring 39 to close the valve.

On the other hand, while the vacuum pump 1 is in operation, the oil pump 35 is put in operation, while holding the ports a-b of the three-way change-over valve 50 in communication with each other. As a result, oil pressure is developed in the oil chamber 45 thereby moving the valve body 38 rightward to open the valve, thereby opening the gas flow passage.

According to the present invention, as clear from the foregoing description, the check valve constructed includes: a valve casing internally providing a gas flow space with a valve seat in an intermediate portion thereof and a cylinder space; a valve body holding the two spaces in shielded state from each other through a suitable seal means and passed through a partition wall between the two spaces to disengageably engage a valve portion on the side of the gas flow space intimately with the valve seat, the valve body having a piston slidably partitioning the cylinder space to provide an oil chamber on the side of the gas flow space and an atmospheric chamber on the opposite side in communication with the atmosphere; a spring means constantly urging the valve body into intimate contact with the valve seat; and bypass passages for communicating the oil chamber with the outlet of the oil cooler and the oil tank through a three-way change-over valve adapted to switch the bypass passages to communicate the oil chamber with either the outlet of the coil cooler or the oil tank.

Thus, the present invention permits to select a spring with a suitable spring constant for seating the valve body on the valve seat securely and promptly to prevent reverse gas flows, and to open the valve securely by hydraulic pressure to secure the gas flow passage without the hunting phenomenon.

What is claimed is:

1. A screw type vacuum pump comprising:

a pump casing having a suction port and a discharge port on opposite sides thereof;

intermeshed male and female rotors comprising means for pumping a gas from said suction port to said discharge port when said rotors are rotated;

power transmission means for rotating said rotors, including a transmission casing having an oil reservoir;

oil circulating means including an oil pump and an oil cooler, for circulating lubricating oil to said pump casing for lubricating said rotors; and a check valve fluidically connected to said suction port and comprising:

(a) a valve casing defining a gas flow space and a cylinder space, said gas flow space being fluidically isolated from said cylinder space and having a valve seat, (b) a valve body for closing said valve seat and sealing said suction port, said valve body including a piston fitted in said cylinder space to divide said cylinder space into an oil chamber and an air chamber at atmospheric pressure, (c) spring means for normally biasing said valve body in a closed position; and (d) a three way change over valve selectively communicating said oil chamber with said oil reservoir when the vacuum pump is stopped and with said oil circulating means at a position downstream of said oil pump when said vacuum pump is operating, whereby oil pressure is applied to said oil chamber from said oil circulating means via said change over valve when said vacuum pump is operated, so that said valve body moves from said closed position to an open position in opposition to the force of the spring means to open fluid communication to said suction port, and whereby the oil pressure is not applied to said oil chamber so that said check valve is closed to prevent reverse rotation of said rotors when said oil pump is stopped and lubricating oil is not circulated to said pump casing.

2. The vacuum pump of claim 1 wherein said valve casing includes a partition wall through which said valve body passes for fluidically isolating said gas flow space from said cylinder space.

3. The vacuum pump of claim 2 wherein said oil chamber is positioned on a side of said cylinder space adjacent said partition wall.

* * * * *